United States Patent [19]

Anderson et al.

[11] Patent Number: 4,555,084

[45] Date of Patent: Nov. 26, 1985

[54] BINGO CARD SUPPORT

[76] Inventors: Clifford E. Anderson, 1610 Alabama St.; Clarence E. Simon, 3606 Dick Taylor St., both of Monroe, La. 71202; Phillip E. Barnes, 104 High Cir., West Monroe, La. 71291

[21] Appl. No.: 585,922

[22] Filed: Mar. 2, 1984

[51] Int. Cl.[4] ..... A47G 1/24; A47B 97/08; A47B 85/06; A63F 3/06

[52] U.S. Cl. ..... 248/460; 248/455; 248/451; 248/558; 248/188; 108/12; 108/38; 273/269

[58] Field of Search ..... 248/460, 473, 455, 451, 248/461, 558, 188, 444; 108/11, 12, 13, 19, 31, 32, 33, 38; 312/111; 273/269, 309

[56] References Cited

U.S. PATENT DOCUMENTS

| | | | |
|---|---|---|---|
| 1,539,198 | 5/1925 | Marsh | 273/309 |
| 3,895,806 | 7/1975 | Burns | 273/287 X |

FOREIGN PATENT DOCUMENTS

| | | | |
|---|---|---|---|
| 524240 | 4/1931 | Fed. Rep. of Germany | 248/461 |
| 220337 | 8/1924 | United Kingdom | 248/444 |
| 1349166 | 3/1974 | United Kingdom | 108/131 |

*Primary Examiner*—Ramon S. Britts
*Assistant Examiner*—Karen Chotkowski
*Attorney, Agent, or Firm*—John M. Harrison

[57] ABSTRACT

A Bingo card support which includes a support frame provided with projecting card support members, which support members are, in one embodiment, capable of retraction in recessed configuration against the support frame surface to provide a substantially unobstructed plane which enables the support frame to be used as a table. Various leg configurations facilitate orientation of the support frame at an angle to display multiple Bingo cards resting on the support members in one variation and to orient the support frame in a horizontal position with respect to the supporting surface, in another variation.

10 Claims, 15 Drawing Figures

BINGO CARD SUPPORT

BACKGROUND OF THE INVENTION

1. Field of the Invention

This invention relates to support members which are used for display purposes and more particularly, to a Bingo card support which is characterized in a preferred embodiment by a generally rectangular support frame oriented at a desired angle with respect to the vertical by means of adjustable legs and provided with spaced, horizontally disposed card support members. In a most preferred embodiment of the invention the card support members are biased against the support frame and are capable of full or partial retraction into the support frame to facilitate a flat surface which can be used as a game board or utility table upon reorientation of the supporting legs.

In playing the game of Bingo, several players obtain as many cards as they are each capable of handling under game conditions and these cards are deployed so as to be easily seen. Each of the cards is divided into twenty-five squares which are arranged in five rows, both horizontally and vertically. The vertical rows are aligned with the letters B-I-N-G-O, respectively, printed along the top margin of the card and each card is printed with a separate sequence of numbers. A "free" space is printed in the center of each card and in the process of playing the game, numbered and lettered tokens are drawn and the inscribed numbers and letters announced to the players, who place a blank marker on each number and letter combination printed on their card which corresponds to the number and letter combination announced. When a player completes five squares in a horizontal or vertical row, or in one of the two diagonal rows, that player calls "Bingo" and wins the game. It is apparent that the chance of winning increases with the number of cards played. However, there is a practical limit to the number of cards which can be effectively played, since the letter and number sequences are announced in rapid succession and a player must possess a particularly good aptitude for the game in order to maintain as many as four cards in each game. Another practical limitation in playing multiple Bingo cards is the limited space available to each player and the difficulty in arranging more than two cards in a spatial orientation which is conducive to rapid playing of each card. This problem is intensified by the game rules, which require that the cards be rapidly cleared of markers at the end of each game and the letter-number tokens again called in rapid succession. Under ordinary circumstances, the Bingo cards procured by the players are arranged in a desired order on a flat table or playing surface and a supply of markers is usually placed in a pile on the table or playing surface near the players. An additional problem is sometimes realized in the dexterity of handling the markers, a problem which is directly proportional to the number of cards played.

2. Description of the Prior Art

Various devices have been proposed for supporting Bingo cards for easy reference in locating and covering random numbers on the cards with tokens or markers of various description. Some of these prior art devices are designed to remain flat in a horizontal orientation in order to avoid spilling discrete markers which are individually placed on the respective numbers printed on the cards. Other Bingo card holders are positioned at an angle with respect to the horizontal to better handle multiple cards fitted with mechanically operated markers. Typical of these devices is the "Holder Board for Bingo Games" disclosed by John J. Burns in U.S. Pat. No. 3,895,806, dated July 22, 1975. The Burns device includes a pair of foldable sections which open to form an A-shaped structure fitted with longitudinal card supporting flanges on each side and wires carrying Bingo markers. A pair of supporting legs are attached to the structure by means of hinges. U.S. Pat. No. 3,811,680, dated May 21, 1974, to Frederick E. Benesch discloses a "Bingo Card Holder" which includes several interlinked boards designed to support multiple Bingo cards. Removable legs are attached to the boards in order to facilitate support of the device in a player's lap at a selected angle. A "Game Board" is disclosed in U.S. Pat. No. 3,458,216, dated July 29, 1969, to A. L. Harrison, which device is foldable and is shaped from a thermoplastic material having a hinge portion which is said to increase in strength proportionately to the number of times that the board is folded. T-shaped divider strips are secured to the board for dividing the board into card-holding areas. U.S. Pat. No. 2,872,215, dated Feb. 3, 1959, to H. A. Taylor discloses a foldable, flexible backing sheet and pocket members oriented on the backing sheet in spaced relationship for removably securing multiple Bingo cards on the backing sheet. Spaces between the pocket members facilitate folding of the backing sheet to stack the pocket members in folded configuration. A "Rapid Marker-Disposal Bingo Game Board Holder" is disclosed in U.S. Pat. No. 2,784,973, dated Mar. 12, 1957, to F. J. Nemec, which holder is characterized by a hinged board member carrying trays for storing markers, which trays cooperate to define a common storage facility for the markers when the board is in folded configuration. The playing board and accompanying trays are designed to facilitate rapid sweeping of markers from playing cards positioned on the board into the trays without spilling the markers.

It is an object of this invention to provide a Bingo card support which is portable, easy to handle and is sufficiently large to accommodate several conventional or mechanical marker Bingo cards simultaneously in an easily reached array.

Another object of the invention is to provide a portable Bingo card support which in one embodiment is capable of displaying multiple Bingo cards while playing the game of Bingo and in another embodiment can be used as a game board or utility table.

A still further object of this invention is to provide a new and improved Bingo Card Support which includes a support frame, multiple longitudinal card support members cooperating with the support frame and adjustable legs supporting the support frame at a selected angle for receiving multiple Bingo cards having mechanical markers, which cards are carried by the support members in one embodiment, the legs adjustable to support the support frame in a horizontal configuration as a game board or utility table, in a second configuration.

Yet another object of this invention is to provide a new and improved portable Bingo card support of superior versatility, strength and durability, which support is inexpensive to produce and maintain.

Still another object of the invention is to provide a portable Bingo card support which is characterized by a support frame of sufficient size to accommodate several Bingo cards in one embodiment and multiple card support members which can be recessed in the frame to present a smooth surface for use in such applications as a clip board, dart board, bulletin board, music or magazine rack and a utility table, in other embodiments.

SUMMARY OF THE INVENTION

These and other objects of this invention are provided in a portable Bingo card support which is characterized in one embodiment by adjustable legs and card support members carried by a support frame in a configuration to support such items as multiple Bingo cards, books or magazines or sheet music and in another embodiment, by a leg configuration and support member orientation which renders the support frame useful as a game board table or a utility table.

BRIEF DESCRIPTION OF THE DRAWINGS

The invention will be better understood by reference to the accompanying drawings, wherein.

DESCRIPTION OF THE PREFERRED EMBODIMENTS

Figure 6:
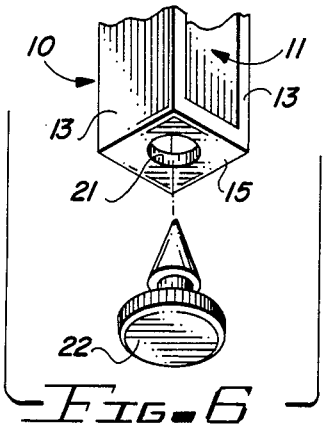
FIG. 6 is a sectional view illustrating a preferred non-skid attachment to the Bingo card support legs.
Figure 2:
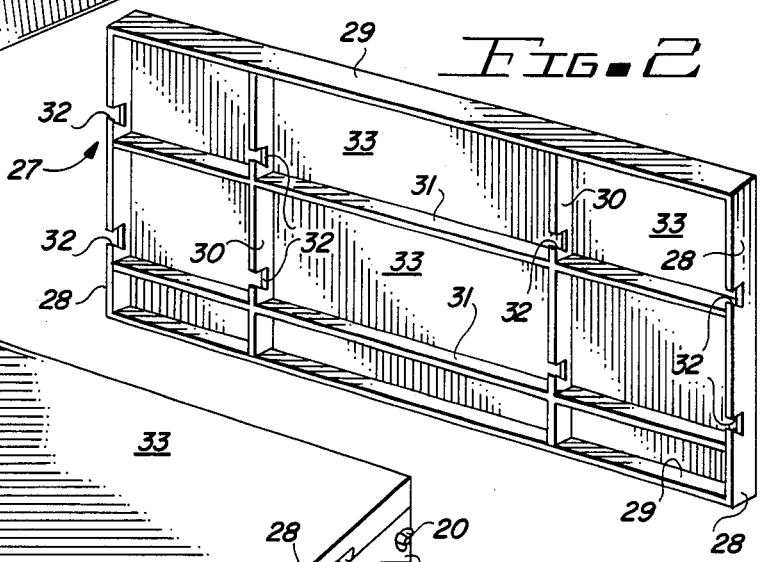
FIG. 2 is a perspective view of an insert for use with the Bingo card support illustrated in FIG. 1.
Figure 3:
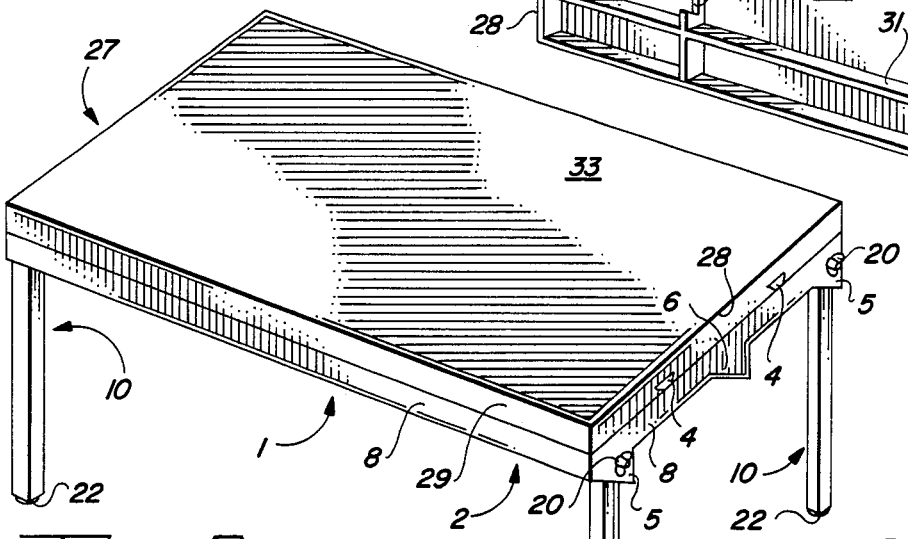
FIG. 3 is a perspective view of a table shaped from the insert illustrated in FIG. 2 in combination with the Bingo card support illustrated in FIG. 1.
Figure 5:
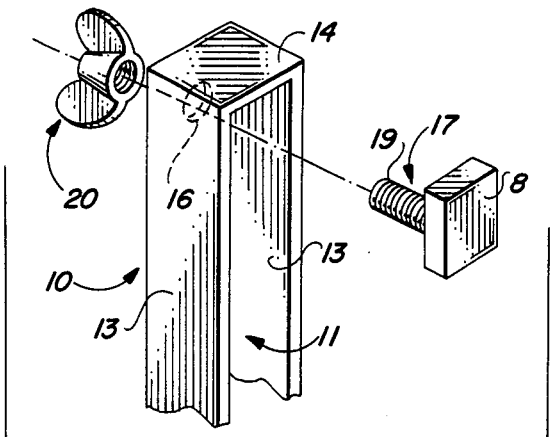
FIG. 5 is a sectional, exploded view of the leg attachment illustrated in FIG. 4.
Figure 4:
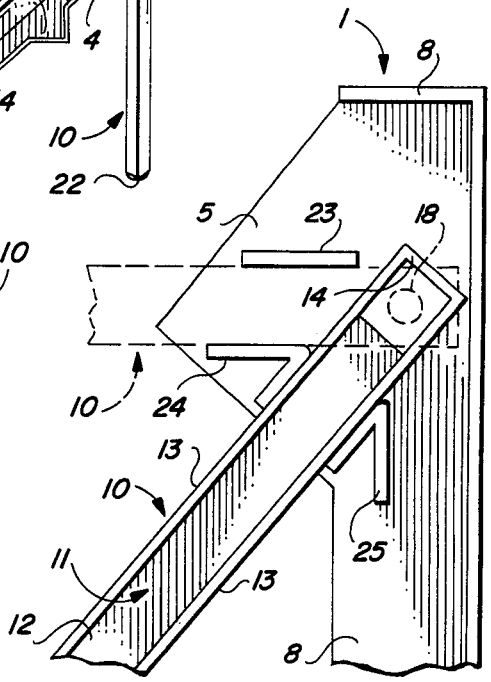
FIG. 4 is a sectional view of a preferred leg attachment in the Bingo card support illustrated in FIG. 1.

In a first most preferred embodiment the Bingo card support of this invention is generally illustrated by reference numeral 1 and includes a generally rectangular shaped support frame 2, provided with a frame border 8 and featuring a handle 7 secured to a top segment of the frame border 8. A generally flat frame surface 3 defines one planar side of the support frame 2 and a pair of dovetail strips 4 are provided in spaced and generally parallel relationship to each other, extending from the frame surface 3. Leg flanges 5 extend from the ends of the two segments of the frame border 8 which define the shortest sides of the support frame 2 and center flanges 6 extend from these same segments at points intermediate the leg flanges 5, as illustrated. One end of each of the primary legs 10 is removably attached to the leg flanges 5, respectively, by means of bolts 17 and cooperating wing nuts 20, as illustrated in FIGS. 4 and 5 of the drawings. In a most preferred embodiment of the invention a recess 11 is defined in each of the primary legs 10 by means of a base member 12 and cooperating side members 13, which extend in spaced relationship from the base member 12. A top end member 14 closes one end of the recess 11, while a bottom end member 15 closes the bottom end of the recess 11 and the bottom end member 15 is provided with a non-skid aperture 21, for receiving a non-skid 22, as illustrated in FIG. 6. Each square bolt head 18 of the bolts 19 fits snugly in a recess 11 in the primary legs 10 and is prevented from rotating as a wing nut 20 is tightened on the threads 19, after the bolts 19 are fitted through the bolt apertures 16 in the respective base members 12. As illustrated in FIG. 4, it will be appreciated that the primary legs 10 can be selectively and adjustably fitted between the top guide 23 and center guide 24 or between the center guide 24 and the bottom guide 25 which are secured to the leg flanges 5, in order to prepare the Bingo card support 1 as a Bingo card support or as a table. For example, referring to FIGS. 2, 4 and 5 of the drawings in a most preferred embodiment of the invention the primary legs 10 can be positioned in the configuration illustrated in phantom in FIG. 4. Accordingly, each of the primary legs 10 is located between a top guide 23 and a center guide 24, respectively, in order to orient the Bingo card support 1 in a table configuration, as illustrated in FIG. 3. This adjustment of the primary legs 10 is achieved by loosening the wing nuts 20 on the threads 19 of the bolts 17 to facilitate moving the primary legs 10 from a first location between the center guides 24 and the bottom guides 25, respectively, as also illustrated in FIG. 4. When the support frame 2 is set up in the configuration illustrated in FIG. 3 a table top insert 27, illustrated in FIG. 2 and provided with dovetail slots 32 which match the shape of the dovetail strips 4 located on the frame surface 3, can be positioned on the support frame 2. In another preferred embodiment of the invention the table top insert 27 is defined by a generally flat table top 33, provided with insert end borders 28, situated on the shortest sides of the table top insert 27 and corresponding insert side borders 29, provided on the longest sides of the table top insert 27. End stiffeners 30 are provided in spaced relationship inside and generally parallel to the insert end borders 28, while side stiffeners 31 are similarly positioned inside and generally parallel to the insert side borders 29. The dovetail slots 32 are provided in successive alignment in the insert end borders 28 and the end stiffeners 30, in order to register with the dovetail strips 4 to removably secure the table top insert 27 on the support frame 2 of the Bingo card support 1 and present the table top 33 as a smooth, planar surface. It will be appreciated that the Bingo card support 1 as so modified by addition of the table top insert 27 can be used as card table, game table or as a utility table, as desired.

Figure 1:
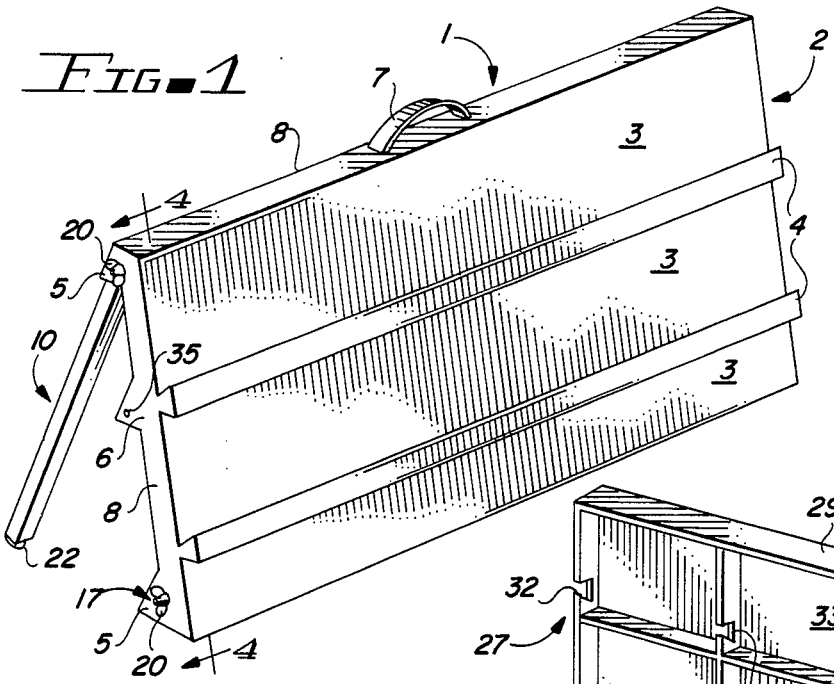
FIG. 1 is a perspective view of a first embodiment of the Bingo card support of this invention.
Figure 7:
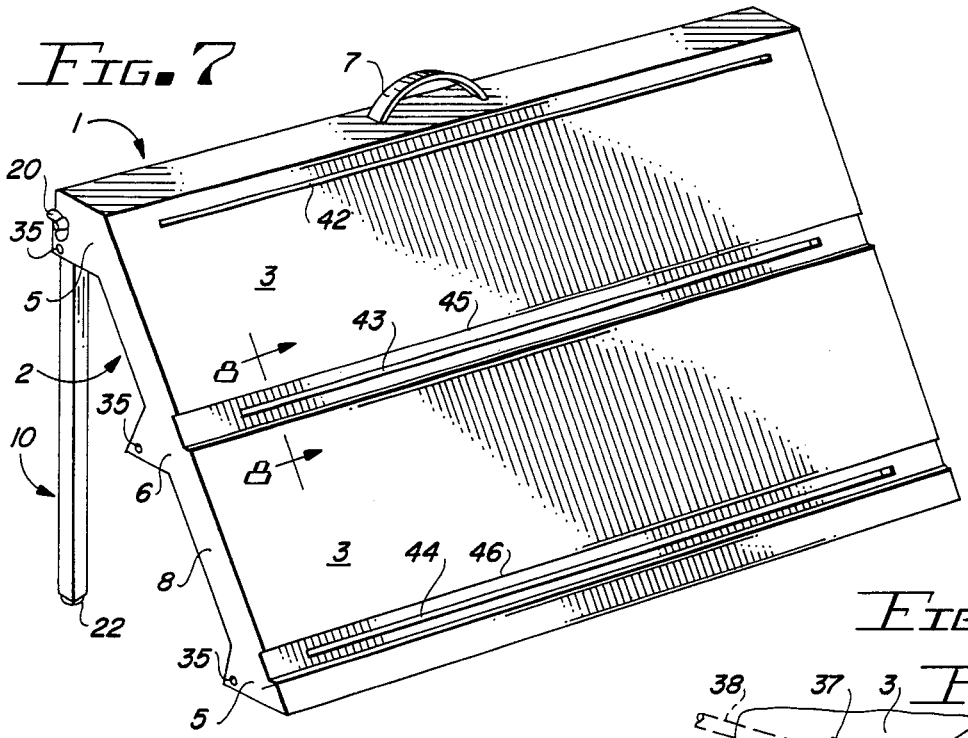
FIG. 7 is a perspective view of a second embodiment of the Bingo card support of this invention.

Referring now to FIG. 7 of the drawings in another most preferred embodiment of the invention the Bingo card support 1 is characterized by a support frame 2 having a frame border 8, leg flanges 5 and center flanges 6, as in the case of the Bingo card support 1 illustrated in FIG. 1. Furthermore, primary legs 10 are also provided in adjustable relationship on the leg flanges 5 and a handle 7 is situated on a top segment of the frame border 8 for carrying purposes. The support frame 2 of the Bingo card support 1 illustrated in FIG. 7 is further provided with a top slot 42, which extends transversly through a segment of the support frame surface 3 below the handle 7. A middle slot 43 extends through a portion of the middle of the frame surface 3 in substantially parallel relationship with respect to the top slot 42 and a bottom slot 44 extends through the frame surface 3 essentially parallel to both the top slot 42 and the middle slot 43, near the bottom of the support frame 2. Furthermore, the middle slot 43 and the bottom slot 44 are positioned in a middle groove 45 and a bottom groove 46, respectively, which extend across the entire length of the frame surface 3, as illustrated.

Figure 8:
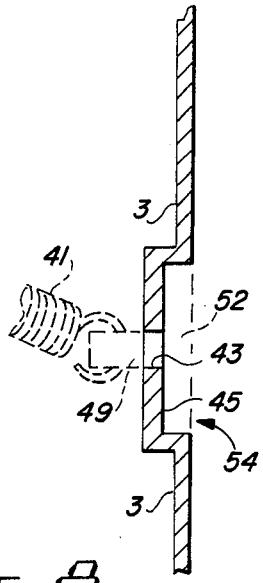
FIG. 8 is a sectional view of a preferred technique of mounting card supporting spring boards to the Bingo card support frame illustrated in FIG. 7.
Figure 9:
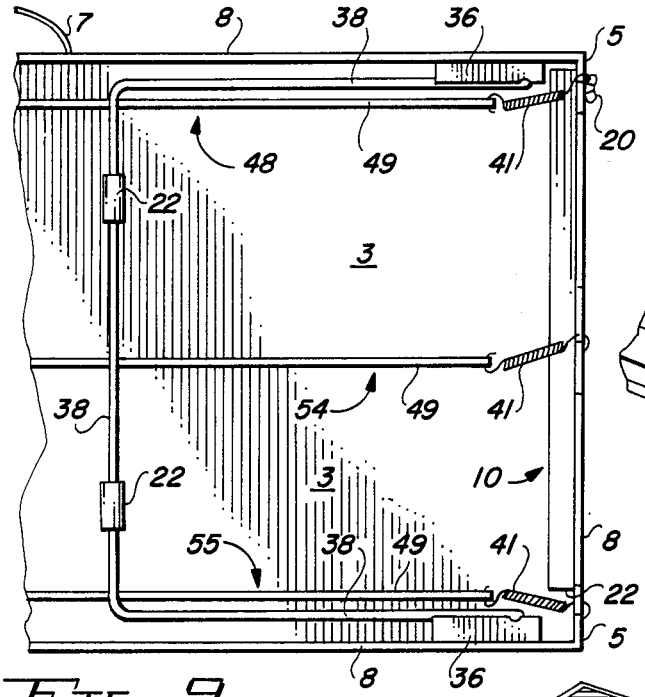
FIG. 9 is a rear elevation, partially in section, of the Bingo card support illustrated in FIG. 7.
Figure 11:
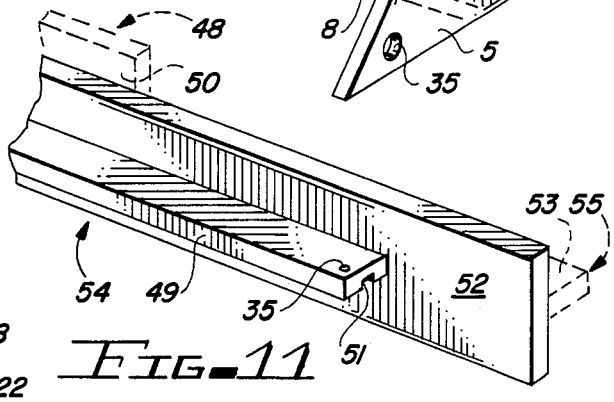
FIG. 11 is a perspective view, partially in section, of a preferred card supporting spring board design.

Referring to FIGS. 8, 9 and 11, in another most preferred embodiment of the invention a top spring board is generally illustrated by reference numeral 48 and is provided with an insert 49, extending from a slat 52. A tab 50, also projecting from the slat 52 and illustrated in phantom, is deployed adjacent the frame surface 3 of the support frame 2, with the insert 49 in registration with the top slot 42, as illustrated in FIGS. 9 and 11. The insert 49 is also provided with an insert slot 51 in one side thereof and spring apertures 35 which are designed to receive springs 41 at each end. The springs 41 also cooperate with the spring apertures 35 located in the top set of leg flanges 5, in order to normally bias the slat 52 of the top spring board 48 against the frame surface 3. A bottom spring board is generally illustrated by reference numeral 55 and is also characterized by a slat 52 and an insert 49 projecting from the slat 52, for registration with the middle slot 43. It will be appreciated from a consideration of FIG. 11, that while the top spring board 48 is characterized by an insert 49 and tab 50 in cooperation with a slat 52, the bottom spring board 55 is provided with the same components, except for the tab 50, including an insert slot 51 in the insert 49 and spring apertures 35. A second set of springs 41 join the insert 49 to a bottom set of leg flanges 5. The bottom spring board 55 further includes a support 53, illustrated in phantom, which extends outwardly of the slat 52 transversly from the frame surface 3 opposite the insert 49, to support multiple Bingo cards. A middle spring board 54 is also provided for association with the middle groove 45 in the frame surface 3, the middle spring board 54 including a slat 52 and an insert 49 projecting from the slat 52 through the middle slot 43, with an insert slot 51 and spring apertures 35 provided in the insert 49. It will be appreciated that the slats 52 in the middle spring board 54 and the bottom spring board 55, respectively, are designed to selectively register with a middle groove 45 and a bottom groove 46, respectively, provided in the frame surface 3. A third set of springs 41 engage the spring apertures 35 in the insert 49 and join the insert 49 to the center flanges 6, also provided with spring apertures 35. This registration occurs when the insert slot 51 of each insert 49 in the middle spring board 54 and bottom spring board 55 is disengaged from that segment of the frame surface 3 which lies adjacent the middle slot 43 and bottom slot 44, respectively. This feature enables the Bingo card support 1 to be utilized as a table having a planar top surface when the top spring board 48 and bottom spring board 55 are removed from association with the support frame 2 by removing the springs 41 from the spring apertures 35 and disengaging the cooperating inserts 49 from the top slot 42 and bottom slot 44, respectively. The Bingo card support 1 can also be used as a table when the top spring board 48, middle spring board 54 and bottom spring board 55 are all removed from the support frame 2, as illustrated in FIG. 12.

Figure 10:
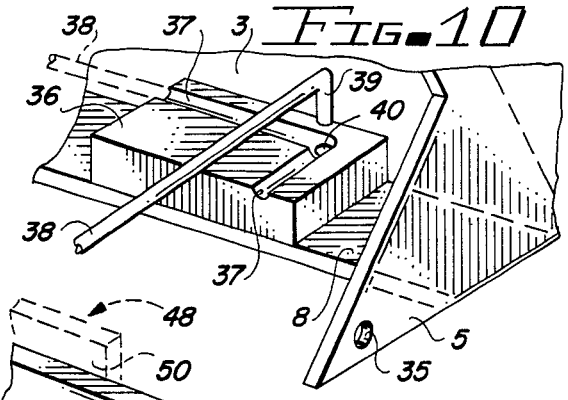
FIG. 10 is a sectional view of a preferred technique of mounting and adjusting a second set of legs to the Bingo card support frame.
Figure 12:
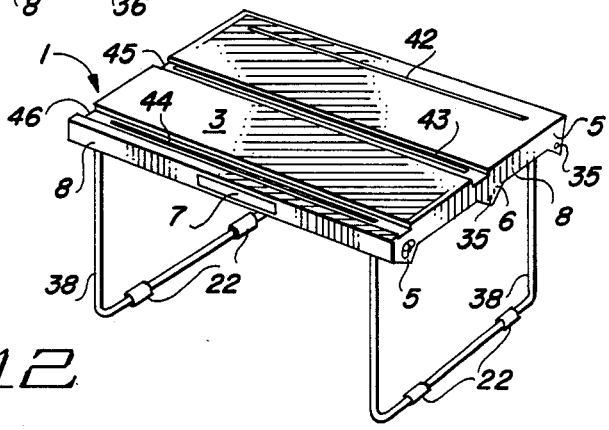
FIG. 12 is a perspective view of a table supported by the second set of legs and defined by the Bingo card support illustrated in FIG. 7.

Referring now to FIGS. 9, 10 and 12 of the drawings in yet another most preferred embodiment of the invention the Bingo card support 1 which is illustrated in both FIGS. 1 and 7 can be utilized as a TV tray or similiar supporting surface by deploying a pair of secondary legs 38, as illustrated in FIG. 12. Secondary legs 38 are each shaped from a single length of stiff metal rod or tubing and are provided with a non skid 22 and a foot 39 on each end. The projecting foot 39 is designed to register with a foot aperture 40, provided in a locking block 36 which is secured to the frame border 8 of the support frame 2. The locking block 36 is provided with grooves 37, which intersect at each foot aperture 40 and selectively receive the upper end of the secondary legs 38 to facilitate either folding the secondary legs 38 inside the frame border 8 as illustrated in FIG. 9, or deploying the secondary legs 38 in functional configuration extending from the support frame 2, as illustrated in FIG. 12. It will be further appreciated that if a particularly sturdy Bingo card support 1 is desired under circumstances where the support frame 2 is to be used as a table to support heavy objects, both the primary legs 10 and the secondary legs 38 can be deployed, as desired.

Figure 13:
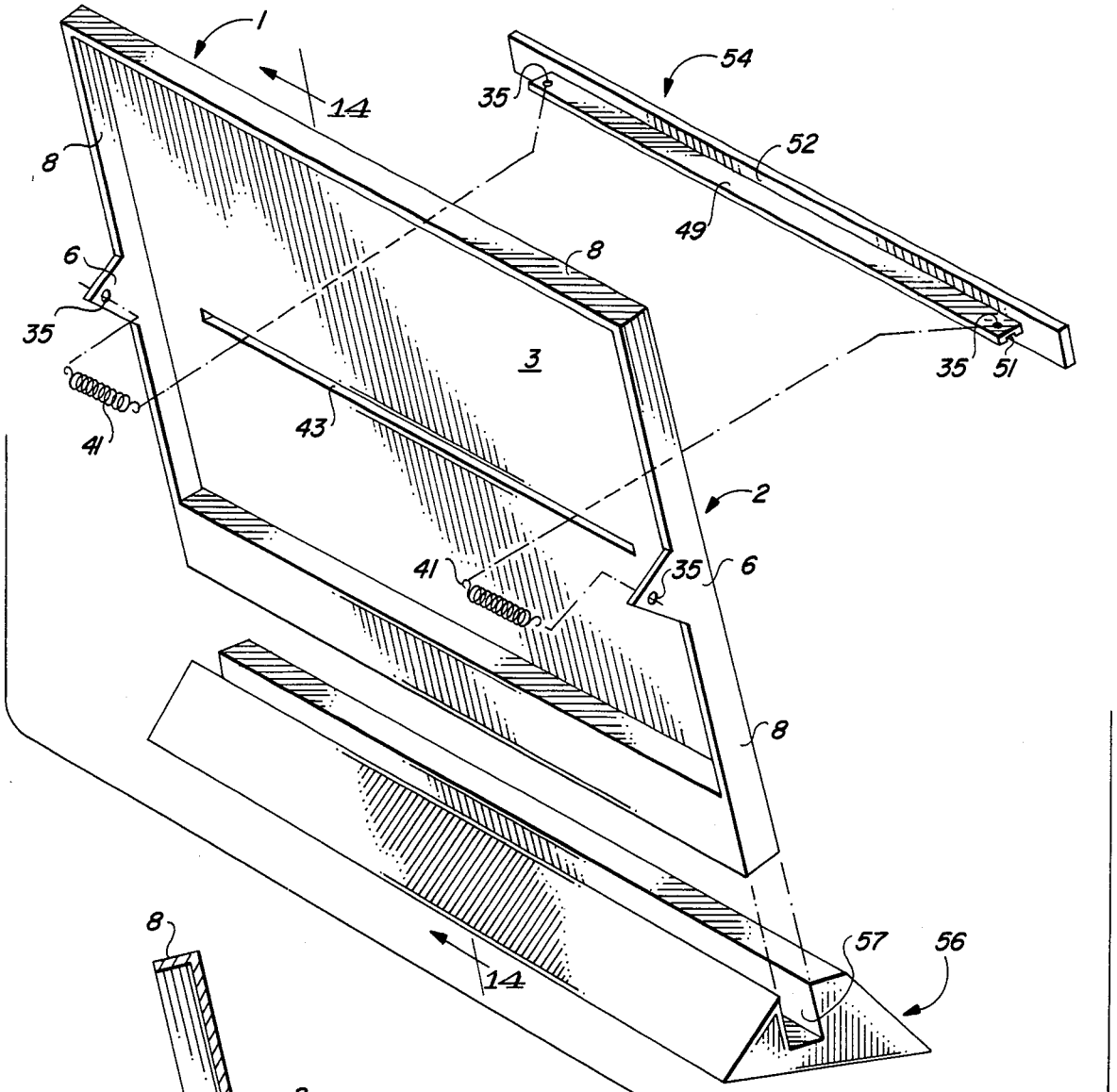
FIG. 13 is a perspective, exploded view of a third embodiment of the Bingo card support of this invention.
Figure 14:
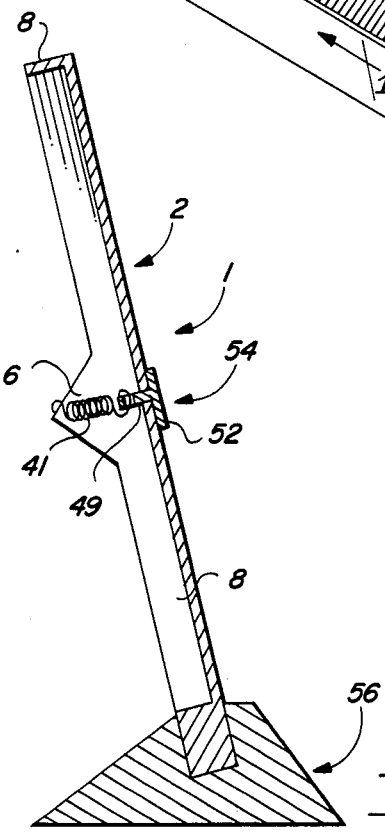
FIG. 14 is a sectional view taken along lines 14—14, of the Bingo card support illustrated in FIG. 13.
Figure 15:
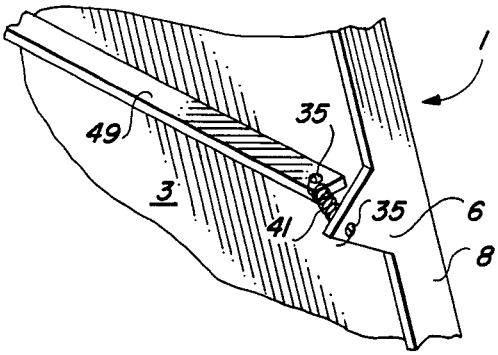
FIG. 15 is a sectional view of a preferred technique of mounting a card supporting spring board to the Bingo card support frame illustrated in FIG. 13.

Referring now to FIGS. 13–15 of the drawings in a third major embodiment of the invention the Bingo card support 1 is characterized by a support frame 2 having frame border 8 and a single set of center flanges 6 provided at a point intermediate the ends of the shortest segments of the frame border 8. A single middle slot 43 is also provided transversly in the frame surface 3. A middle spring board 54, provided with a slat 52 and an insert 49 is oriented with the insert 49 in registration with the middle slot 43 and springs 41 serve to engage the spring apertures 35 in the center flanges 6 and the insert 49, to bias the slat 52 against the frame surface 3. As in the case of the middle spring board 54 and bottom spring board 55 illustrated in FIGS. 7–11, the insert 49 is provided with an insert slot 51 on one side thereof, to engage a segment of the frame surface 3 located adjacent the middle slot 43 and selectively project the slat 52 outwardly of the frame surface 3, in order to support multiple Bingo cards. In another most preferred embodiment of the invention the bottom edge of the support frame 2 is designed to removably seat in a base slot 57 of a portable base 56, as illustrated in FIGS. 13 and 14.

It will be appreciated from a consideration of the drawings that the Bingo card support 1 of this invention is a versatile and useful supporting device which has many functions. In addition to the functions of serving as support for Bingo cards and a game table or utility table, the Bingo card support of this invention can also serve as a dart board, an easel for painting or drafting, a portable bulletin board, a sheet music holder, a clip board, a work mate for home computing and many similar functions, in non-exclusive particular. For example, referring again to FIGS. 9 and 11 of the drawings, it will be appreciated that the slat 52 in the top spring board 48 is tightly pressed against the frame surface 3 by action of the springs 41, when the insert slot 51 of the insert 49 is disengaged from that segment of the frame surface 3 which lies adjacent the top slot 42. Accordingly, the Bingo card support 1 can be used as a clip board by inserting Bingo cards or other papers between the slat 52 or the tab 50 and the supporting frame surface 3. Furthermore, when the slat 52 in the middle spring board 54 is extended from the middle groove 45 to a point above the frame surface 3 by engaging the insert slot 51 with that portion of the frame surface 3 which lies adjacent the middle slot 43, Bingo cards can be supported on that segment of the insert 49 which extends between the insert slot 51 and the slat 52. In a third embodiment, the Bingo card support 1 can be used to support books, drawings or other bulky materials for display purposes, as well as Bingo cards, by extending the bottom spring board 55 against the bias of the cooperating springs 41 and locking the insert slot 51 of the insert 49 in the frame surface 3 adjacent the bottom slot 44, to extend both the slat 52 and the support 53 from the frame surface 3.

It will be further appreciated that the Bingo card support 1 can be manufactured of many different materials, including wood, plastic, fiberglass and like materials, in non-exclusive particular. Furthermore, the springs 41 can be characterized by coil springs of selected tension and length, as desired.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. A bingo card support comprising:

(a) a substantially flat frame surface, a border extending aroung the periphery of said frame surface and leg flanges extending from said border;

(b) at least four legs adjustably and removably carried by said leg flanges in spaced relationship;

(c) three slots provided in spaced relationship in said frame surface;

(d) spring biased boards carried by said slots in said frame surface; and (e) spring means in association with said spring biased boards, whereby said spring biased boards are normally biased against said frame surface.

2. The Bingo card support of claim 1 further comprising a pair of auxiliary legs in pivotal cooperation with said frame surface for supporting said frame surface in substantially horizontal orientation.

3. The Bingo card support of claim 1 further comprising a top guide secured to an upper surface of each of said leg flanges, a center guide secured to a middle surface of each of said leg flanges and a bottom guide secured to a lower surface of each of said leg flanges, said top guide, said center guide and said bottom guide oriented on said leg flanges in spaced relationship and said legs adjustably carried in selected orientation on said leg flanges at a first point between said top guide and said center guide, and a second point between said center guide and said bottom guide, respectively.

4. The Bingo card support of claim 3 further comprising a pair of auxiliary legs in pivotal cooperation with said frame surface for additionally supporting said frame surface in substantially horizontal orientation.

5. A Bingo card support comprising:

(a) a support frame having a substantially flat frame surface and a border extending around the periphery of said frame surface;

(b) at least four leg flanges extending from said border in spaced relationship and four primary legs adjustably carried by said leg flanges;

(c) a pair of dovetail strips attached to said frame surface in spaced relationship; and (d) a top guide carried by each of said leg flanges, a middle guide carried by each of said leg flanges in spaced relationship with respect to said top guide and a bottom guide carried by each of said leg flanges in spaced relationship with respect to said middle guide, whereby said legs are selectively positioned between said top guide and said middle guide and between said middle guide and said bottom guide, respectively.

6. The Bingo card support of claim 5 further comprising a pair of auxiliary legs in pivotal cooperation with said support frame for additionally supporting said support frame in substantially horizontal orientation.

7. A Bingo card support comprising:

(a) a support frame having a substantially flat frame surface and a border extending around the periphery of said frame surface;

(b) six leg flanges extending from said border in spaced relationship and four primary legs adjustably carried by four of said leg flanges;

(c) a first slot extending transversly through said frame surface, a second slot extending transversly through said frame surface in spaced, parallel relationship with respect to said first slot and a third slot extending transversely through said frame surface in spaced, parallel relationship with respect to said second slot; and (d) first spring biased board means and a first insert carried by said first spring biased board means with said first insert in registration with said first slot; second spring biased board means and a second insert carried by said second spring biased board means with said second insert in registration with said second slot; and third spring biased board means and a third insert carried by said third spring biased board means, with said third insert in registration with said third slot.

8. The Bingo card holder of claim 7 further comprising springs attached to said support frame and to said first insert, said second insert and said third insert, respectively, whereby said first spring biased board means, said second spring board means and said third spring biased board means are biased against said frame surface.

9. The Bingo card holder of claim 7 further comprising a pair of auxiliary legs in pivotal cooperation with said support frame for additionaly supporting said support frame in substantially horizontal orientation.

10. The bingo card holder of claim 7 further comprising:

(a) springs attached to said support frame and to said first insert, said second insert and said third insert, respectively, whereby said first spring biased board means, said second spring board means and said third spring biased board means are biased against said frame surface; and (b) a pair of auxiliary legs in pivotal cooperation with said support frame for additionally supporting said support frame in substantially horizontal orientation.

* * * * *